US008947977B1

(12) United States Patent
Tomlinson et al.

(10) Patent No.: US 8,947,977 B1
(45) Date of Patent: Feb. 3, 2015

(54) FUZING ARRANGEMENTS

(76) Inventors: James Tomlinson, Wells (GB); Brian Jackson, Wells (GB)

( * ) Notice: Subject to any disclaimer, the term of this patent is extended or adjusted under 35 U.S.C. 154(b) by 0 days.

(21) Appl. No.: 05/504,958

(22) Filed: Sep. 6, 1974

(30) Foreign Application Priority Data

Sep. 18, 1973 (GB) ..... 43820

(51) Int. Cl.
*F42C 13/02* (2006.01)

(52) U.S. Cl.
USPC ..... 367/97; 342/68; 102/427

(58) Field of Classification Search
CPC ..... F42C 13/04; F42C 13/042; F42C 11/007
USPC ..... 367/97; 342/68; 102/427
See application file for complete search history.

(56) References Cited

U.S. PATENT DOCUMENTS 3,149,333 A * 9/1964 Campbell ..... 343/5 AGC
3,614,781 A * 10/1971 Lichtman ..... 343/7 PF
3,719,944 A * 3/1973 Adrian ..... 343/7 PF
3,802,343 A * 4/1974 Dahl ..... 102/70.2 P
3,821,737 A * 6/1974 Kalmus ..... 343/7 PF
3,877,377 A * 4/1975 Rabinow ..... 102/70.2 P
3,882,495 A * 5/1975 Bolger ..... 343/7.7 X

* cited by examiner

*Primary Examiner* — Daniel Pihulic
(74) *Attorney, Agent, or Firm* — Crowell & Moring LLP

(57) ABSTRACT

A proximity fuzing arrangement for fuzing warheads carried by missiles which reduces the likelihood of the missile being detonated prematurely by such cases as rain or enemy counter measures. The fuzing arrangement includes at least two channels responsive to target signals in different frequency bands and also includes means for comparing the signals in these channels to distinguish between spurious signals such as enemy counter measures or rain and so called "true target signals".

9 Claims, 1 Drawing Sheet

FUZING ARRANGEMENTS

The present invention relates to fuzing arrangements, and it relates especially to proximity fuzing arrangements for fuzing warheads carried by missiles.

It is known that proximity fuzes, i.e., fuzes which cause the detonation of a warhead when it is at a predetermined distance away from a target, the distance depending upon the conditions of attack, are substantially more lethal than impact fuzes. It is therefore of advantage to utilise proximity fuzes in missiles, but such fuzes can be caused to trigger prematurely by external causes such as enemy counter measures or naturally occurring phenomena such as rain.

It is an object of this invention to provide a proximity fuzing arrangement in which the abovementioned difficulties are reduced.

According to the invention there is provided a proximity fuzing arrangement comprising means for transmitting radiation and receiving such radiation after reflection from echo sources, means for processing the received radiation so as to derive target signals indicative by their frequency of relative motion between the transmitting and receiving means on the one hand and echo sources on the other hand, a plurality greater than two of signal channels, each responsive to target signals in differing respective frequency bands, and means for comparing the signals of said channels so as to permit the arrangement to distinguish true target signals from spurious signals where the terms "true target signals" and "spurious signals" as hereinafter described. Preferably one of said channels responds to a frequency band which encompasses substantially all target signals produced by rain and the said channel is coupled to a gain control circuit preceding the said channels so as to permit the signals fed to said channels to be reduced in the presence of rain.

In order that the invention may be clearly understood and readily carried into effect, one embodiment thereof will now be described, by way of example only, with reference to the accompanying drawings, of which: —

Figure 1:
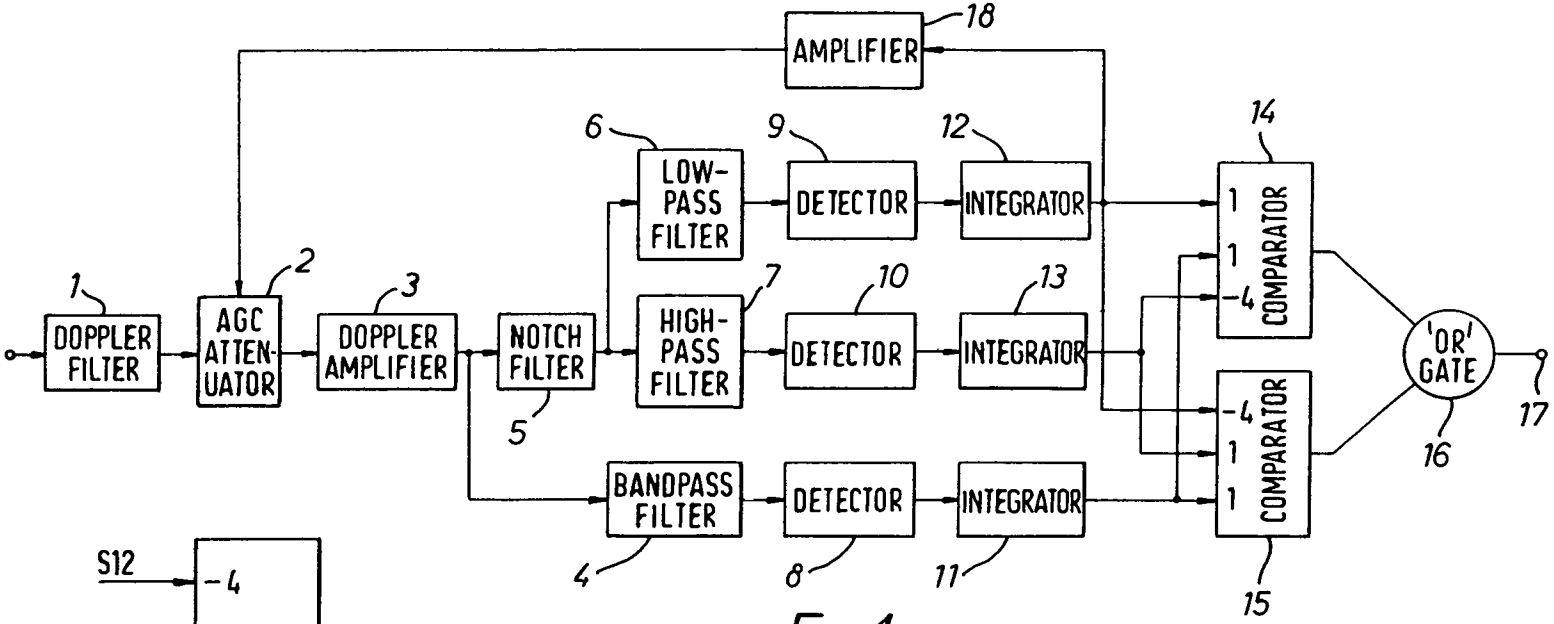
Figure 2:
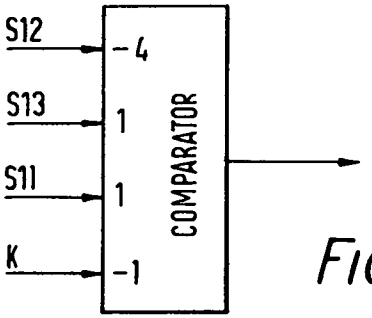

FIG. 1 shows in block diagrammatic form, part of a fuzing arrangement in accordance with one example of the invention, and FIG. 2 shows a modification to that arrangement in accordance with one example of the invention.

Referring now to FIG. 1, target signals indicative by their frequency of the relative speed between a missile and one or more echo sources are applied to a Doppler filter 1 which has a pass band between 1 KHz and 100 KHz, which encompasses the useful band of target signal frequencies and thus serves to reject noise signals outside this band. The signals passed by filter 1 are fed to an automatic gain control attenuator 2 and thence to an amplifier 3 which is arranged to effect amplification by about 50 dB, with substantially constant effect over the whole spectrum of frequencies passed via the filter 1.

Amplified target signals from the amplifier 3 are fed in parallel to a bandpass filter 4, which has a pass band of 30 KHz to 70 KHz, and to a notch filter 5 which has a stop band substantially centred on the centre of pass band of filter 4, i.e. 50 KHz. The notch filter 5 feeds, in parallel, a low bandpass filter 6 which has a pass band from 1 KHz to 30 KHz and a high bandpass filter 7 which has a pass band from 70 KHz to 100 KHz. Each of the filters 4, 6 and 7 feeds a respective one of three detector circuits 8, 9 and 10 and each detector circuit feeds a respective one of three 0.1 millisecond integrating circuits 11, 12 and 13.

The signals passed by filter 4 will contain rain and ECM signals, which will be known as "spurious signals", and also "true target signals" where "true target signals" are those received by reflection from an intended enemy target.

Output signals S11, S12 and S13 each from respective integrators 11, 12 and 13 are applied in parallel to two comparing circuits 14 and 15; the two comparing circuits comprising summing and differencing circuits and being effective to form the combinations:

S11+S12−4S13 and

−4S12+S11+S13 respectively.

If either of circuits 14 or 15 produces a positive output signal from its comparison of weighted positive and negative values, the said output signal is passed via an 'OR' gate 16 to the trigger output terminal 17. The output signal is then processed to fire the warhead in accordance with predetermined proximity conditions consistent with the prevailing attack situation. Such processing is known and will not be more fully described herein. In this example a weighting factor of four is applied to noise signals S12, and S13 though any suitable weighting factor could be used.

It will be observed that, in view of the signal comparison which is effected between target signals passed through the three signal channels, the notch filter 5 is used to provide good signal separation (i.e. lack of cross talk) between the various channels.

By means of the comparisons, it is ensured that, in the presence of a target signal, a subtraction of noise from signal plus noise is carried out, in one or other of the circuits 14 or 15. Since ECM is generally presented as broad band noise it appears, if present, on all three signal channels, however, the required target signals are substantially confined to the band of filter 4. The subtraction process therefore provides the target signals substantially free of ECM signals. A reduction in noise also occurs because of the reduction in bandwidth of the signals in the various channels.

The present example of the invention includes a further refinement, namely an automatic gain control signal which is derived from the output of integrator 12 and is fed via an amplifier 18 to the automatic gain control attenuator 2. This expedient permits the sensitivity of the fuze arrangement to be reduced during rain, but only to the extent necessary to prevent premature firing. It has been found that the target signals derived in response to rain fall substantially entirely within the frequency band of the filter 6. Thus, in the presence of signals within the frequency band, the gain of the arrangement is reduced by an amount dependent upon the amplitude of such signals. This does not totally "blind" the missile, even when the gain is reduced by a substantial amount, since the signals to be compared in circuits 14 and 15 have all been equally affected by the reduction in gain.

Previously it has been usual in fuzing arrangements to use an automatic gain control signal derived from noise channels to suppress the gain of the system in the presence of constant ECM in a manner similar to that described above for rain. However, such methods are vulnerable to switched ECM, when the ECM signals are switched off the gain of such a system rises to its normal level and if the ECM signals are then switched on again the automatic gain control may not reduce the gain fast enough to prevent triggering. The arrangement described above, however, involves direct comparison and, not being subject to the delay of the automatic gain control, is able to protect against switched ECM in addition to constant ECM. Further protection against switched ECM may be obtained by arranging that the reference channel integrators 12 and 13 have a short rise time and a longer fall time than the other integrator.

A further modification to the invention is obtained if either or both of the comparators 14 and 15 is replaced by a comparator as shown in FIG. 2. A constant term k is added to one or both of the noise channel signals S12 and S13 to form the combinations: —

S11+S12−4S13−k and

S11+S13−4S12−k the comparator shown in FIG. 2 is arranged to provide the second condition and is therefore a replacement for comparator 15. The comparator then compares positive and negative values and responds in the same manner as in said comparator's un-modified design. Although k is shown as a signal applied to a separate −1 input other arrangements may be used to achieve the same effect. Adjustment of the factor k gives control of the rate at which false alarms are generated by noise signals present on the channel to which it is added. Thus, in the arrangement of FIG. 2, k is added to the signal which would include any noise due to rain. The factor k is then used to adjust the threshold of response to rain. Means may be provided for k to be responsive to the level of signal S12 such that the false alarm rate remains constant in the presence of rain. In such a case it may be possible to omit the amplifier 18 and automatic gain control 2. Similar arrangements may be made for the other channels.

The embodiment of the invention described hereinbefore is a preferred embodiment, but it is not the only practical realisation of the invention. For example, a straightforward approach is to use three comparators, one for each channel, the outputs of which feed a common 'OR' gate. In this case, each comparator is balanced—i.e. it has a positive and negative input. The positive input to each comparator is the signal derived from its respective channel, whereas the negative input in each case represents the sum of the signals derived from the other two channels. In this way, each comparator is based off by noise in the other two channels.

What we claim is:

1. A proximity fuzing arrangement comprising means for transmitting radiation and receiving such radiation after reflection from echo sources, means for processing the received radiation so as to derive target signals indicative by their frequency of relative motion between the transmitting and receiving means on the one hand and the echo sources on the other hand, at least three signal channels, each effective to pass target signals in a respective frequency band, the signals S11 passed by a first of said channels including true target signals and spurious signals, the signals S12 passed by a second of said channels encompassing substantially all signals produced in response to rain, and the signals S13 passed by a third of said channels including substantially only signals produced in response to enemy counter measures, and means for combining the signals passed by said channels to distinguish true target signals from spurious signals, the means for combining being adapted to form the combinations S11+S12−mS13 and S11+S13−mS12, where m is a constant, in separate combining circuits and outputs a signal, via suitable electronic components, to a trigger arrangement when either of said combinations is of a predetermined character.

2. A system according to claim 1 wherein one of said channels responds to a frequency band which encompasses substantially all target signals produced by rain and the said channel is coupled to a gain control circuit preceding the said channels so as to permit the signals to said channels to be reduced in the presence of rain.

3. A system according to claim 1 wherein an offset signal, k, is added to one or both of said signals S12 and S13, of such a value as to give a required control of the rate at which false alarms are generated by signal fluctuations.

4. A system according to claim 3 wherein said offset signal, k, is arranged to be responsive to the level of said signals S12, so as to be of such a value as to afford a required adjustment of the threshold of response of the system to rain.

5. In a proximity fuzing arrangement for fuzing a warhead carried by a missile, and including means for obtaining input signals indicative by their frequency of relative speed between the missile and a target but being susceptible to contamination by enemy counter measures and natural precipitation, a circuit arrangement for receiving said input signals and discriminating against said contamination, the circuit arrangement comprising a first channel adapted by filtering to pass substantially only signal components included in said input signals indicative of contamination due to enemy counter measures, a second channel adapted by filtering to pass substantially only signal components included in said input signals and indicative of contamination due to natural precipitation and enemy counter measures, a third channel adapted by filtering to pass signal components, included in said input signals, and indicative of true target signals and/enemy counter measures, and combining circuits connected to receive the signal components passed by the three channels and to form weighted combinations of said components, said combining circuits comprising a first circuit for combining the signal components passed by all three channels with discrimination against signal components passed by said first channel, a second circuit for combining the signal components passed by all three channels with discrimination against signal components passed by said second channel, and gating means for responding to an output signal, derived from either of said first and second circuits and having a predetermined characteristic and conveying such output signal to trigger circuit means included in said fuzing arrangement.

6. An arrangement according to claim 5 wherein said first circuit for combining is adapted to add together the signal components passed by said second and third channels and to subtract from the sum an integral multiple of the signal components passed by said first channel, and wherein said second circuit for combining is adapted to add together the signal components passed by said first and third channels and to subtract from the sum an integral multiple of the signal components passed by said second channel.

7. An arrangement according to claim 6 wherein the two integral multiplying factors are equal.

8. An arrangement according to claim 6 wherein both of said factors equal four.

9. An arrangement according to claim 5 including automatic gain control amplifier means connected to receive the signal components passed by said second channel and to convey such components to a common automatic gain control attenuator means in the path of said input signals to each of said channels.

* * * * *